US007808515B2

(12) United States Patent
Kang

(10) Patent No.: US 7,808,515 B2
(45) Date of Patent: Oct. 5, 2010

(54) METHOD OF DRIVING PLASMA DISPLAY PANEL (PDP) AND PDP DRIVEN USING THE METHOD

(75) Inventor: Kyoung-Doo Kang, Suwon-si (KR)

(73) Assignee: Samsung SDI Co., Ltd., Gongse-dong, Giheung-gu, Yongin-si, Gyeonggi-do (KR)

( * ) Notice: Subject to any disclaimer, the term of this patent is extended or adjusted under 35 U.S.C. 154(b) by 1098 days.

(21) Appl. No.: 11/444,409

(22) Filed: Jun. 1, 2006

(65) Prior Publication Data

US 2006/0279485 A1 Dec. 14, 2006

(30) Foreign Application Priority Data

Jun. 11, 2005 (KR) ..... 10-2005-0050140

(51) Int. Cl.
*G09G 5/10* (2006.01)
*H01J 17/49* (2006.01)

(52) U.S. Cl. ..... 345/691; 345/55; 345/60; 345/67; 345/204; 345/690; 313/567; 313/581; 313/582; 313/609; 313/610

(58) Field of Classification Search ..... 345/55, 345/60, 65, 67, 68, 204, 205, 690, 691; 313/483, 313/484, 485, 491, 567, 581, 582, 609, 610
See application file for complete search history.

(56) References Cited

U.S. PATENT DOCUMENTS 5,541,618 A 7/1996 Shinoda
5,661,500 A 8/1997 Shinoda et al.

(Continued)

FOREIGN PATENT DOCUMENTS

EP 0 866 439 9/1998

(Continued)

OTHER PUBLICATIONS

European Office Action for corresponding European Patent Application No. 06115201.3-1228, issued on Jan. 8, 2007.

(Continued)

*Primary Examiner*—My-Chau T Tran
(74) *Attorney, Agent, or Firm*—Robert E. Bushnell, Esq.

(57) ABSTRACT

A method of driving a plasma display panel (PDP) that includes providing a plurality of X electrodes and a plurality of Y electrodes extending in a first direction, a plurality of A electrodes arranged between the X electrode and the Y electrode and extending in a second direction that crosses the plurality of X electrodes and the plurality of Y electrodes, and a plurality of discharge cells arranged in a region where the A electrodes cross the X electrodes and the Y electrodes. The PDP being driven by applying a pulse waveform voltage alternating between a low level voltage and a high level voltage to the X electrodes and applying a pulse waveform voltage alternating between the high level voltage and the low level voltage to the Y electrodes during a sustain discharge period when sustain discharging occurs in selected ones of the plurality of discharge cells. Voltages and/or pulse widths of the second pulse in the sustain discharge period are made different than other pulses in the sustain discharge period.

13 Claims, 14 Drawing Sheets

U.S. PATENT DOCUMENTS

| | | | | |
|---|---|---|---|---|
| 5,663,741 | A | 9/1997 | Kanazawa | |
| 5,674,553 | A | 10/1997 | Shinoda et al. | |
| 5,724,054 | A | 3/1998 | Shinoda | |
| 5,786,794 | A | 7/1998 | Kishi et al. | |
| 5,952,782 | A | 9/1999 | Nanto | |
| 6,292,159 | B1 | 9/2001 | Someya et al. | |
| RE37,444 | E | 11/2001 | Kanazawa | |
| 6,404,411 | B1 * | 6/2002 | Masuda et al. | 345/66 |
| 6,603,448 | B2 * | 8/2003 | Kado et al. | 345/60 |
| 6,630,916 | B1 | 10/2003 | Shinoda | |
| 6,707,436 | B2 | 3/2004 | Setoguchi et al. | |
| 7,436,375 | B2 * | 10/2008 | Hirakawa et al. | 345/60 |
| 7,518,310 | B2 * | 4/2009 | Yoo et al. | 313/585 |
| 2002/0054002 | A1 | 5/2002 | Tokunaga et al. | |
| 2002/0195963 | A1 | 12/2002 | Tokunaga et al. | |
| 2005/0078061 | A1 | 4/2005 | Kim et al. | |
| 2005/0116646 | A1 | 6/2005 | Yoo et al. | |
| 2006/0022967 | A1 * | 2/2006 | Hirakawa et al. | 345/204 |

FOREIGN PATENT DOCUMENTS

| | | |
|---|---|---|
| EP | 1 246 156 | 10/2002 |
| EP | 1 357 535 | 10/2003 |
| EP | 1 528 588 | 5/2005 |
| EP | 1 530 193 | 5/2005 |
| JP | 02-148645 | 6/1990 |
| JP | 9-34397 | 2/1997 |
| JP | 2845183 | 10/1998 |
| JP | H10-319901 | 12/1998 |
| JP | H10-333635 | 12/1998 |
| JP | 2917279 | 4/1999 |
| JP | 2000-155556 | 6/2000 |
| JP | 2001-043804 | 2/2001 |
| JP | 2001-228820 | 8/2001 |
| JP | 2001-325888 | 11/2001 |
| JP | 2002-207449 | 7/2002 |
| JP | 2002-351396 | 12/2002 |
| JP | 2004-333904 | 11/2004 |
| JP | 2004-349058 | 12/2004 |
| JP | 2005-37515 | 2/2005 |
| JP | 2005-166654 | 6/2005 |
| KR | 10-2005-0052205 | 6/2005 |

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms and Discharge Characteristics; Annex C—Gaps and Annex D—Manufacturing.

Korean Office Action for corresponding Korean Patent Application No. 2005-0050140, issued on Oct. 23, 2006.

Transmittal letter and Japanese Office action issued on Nov. 4, 2009 in Applicant's corresponding Japanese Patent Application No. 2006-102419.

* cited by examiner

METHOD OF DRIVING PLASMA DISPLAY PANEL (PDP) AND PDP DRIVEN USING THE METHOD

This application makes reference to, incorporates the same herein, and claims all benefits accruing under 35 U.S.C.§119 from an application for METHOD FOR DRIVING PLASMA DISPLAY PANEL AND PLASMA DISPLAY PANEL DRIVEN BY THE SAME METHOD earlier filed in the Korean Intellectual Property Office on 11 Jun. 2005 and there duly assigned Serial No. 10-2005-0050140.

BACKGROUND OF THE INVENTION

1. Field of the Invention

The present invention relates to a method of driving a plasma display panel (PDP) and a PDP driven by the method, and more particularly, to a method of stably performing sustain discharges after a second sustain discharge in a sustain discharge period and a PDP structure for carrying out said method.

2. Description of the Related Art

A plasma display device includes a plasma display panel (PDP), which is a type of flat display device having a wide screen. Plasma display devices display a desired image by applying discharge voltage between two panels of the PDP in which a plurality of electrodes are formed to generate vacuum ultraviolet radiation, and exciting a phosphor by the vacuum ultraviolet radiation to produce visible rays that display the image.

A PDP has a front panel and a rear panel. The front panel includes a front substrate, a plurality of common electrodes each including a transparent electrode and a bus electrode, a plurality of scan electrodes each including a transparent electrode and a bus electrode, a dielectric layer, and a protection layer. The rear panel includes a rear substrate, a plurality of address electrodes, a dielectric layer, a plurality of barrier ribs, and a phosphor layer. The front substrate and the rear substrate are spaced apart from each other and face each other. Space between the front and rear substrates and is partitioned by the barrier ribs into a plurality of discharge cells. A dielectric substance is included near the discharge cells to achieve a panel capacitance. The discharge cells can be similarly formed using the panel capacitance and a panel capacitor combined with electrodes surrounding the discharge cells.

In driving such a PDP, an address display separation (ADS) scheme is used. A unit frame is divided into a plurality of sub-fields to display an image on the PDP. Each of the sub-fields includes a reset period, an address period, and a sustain discharge period. In each of these three periods, different driving waveform voltages are applied to each of the common electrodes, the scan electrodes, and the address electrodes. In the reset period, a ramp type reset pulse voltage is applied to a scan electrodes. In the address period, a scan pulse voltage is applied to a scan electrodes and an address pulse voltage is applied to an address electrodes. In a sustain discharge period, sustain pulse voltages are alternately applied to a common electrodes and the scan electrodes.

The PDP has low optical transmission with regard to visible rays passing through the front substrate, since the visible rays generated by exciting the phosphor must pass through a pair of sustain discharge electrodes, the dielectric layer, and the protection layer of the front substrate in order to pass through the front substrate. The PDP also has low light-emitting efficiency since the pair of sustain discharge electrodes are disposed at the front of the discharge cells including the front and rear sides thereof. A sustain discharge between the pair of sustain discharge electrodes occurs only at the front of the discharge cells, so that the discharge space is not efficiently used. Also, charged particles generated by the sustain discharge occurring at the front of the discharge cell ion-sputter the phosphor layer at the rear of the discharge cell, causing a permanent afterimage.

To solve the above problems, a PDP has been developed that has an improved structure in which the pair of sustain discharge electrodes are disposed on a barrier rib forming the sides of the discharge cell. However, the PDP having the improved structure has a different electrode structure from the above PDP. Therefore, unexpected problems may occur when the driving waveform voltages are applied to such a structure. Therefore, what is needed is an improved structure for a plasma display device and improved waveforms for driving the electrodes of the improved plasma display device that overcomes these problems.

SUMMARY OF THE INVENTION

It is therefore an object of the present invention to provide an improved design for a plasma display panel.

It is also an object of the present invention to provide an improved method of driving the improved plasma display panel.

It is yet an object of the present invention to provide a better match between the design of the PDP and the voltages that are applied to the electrodes to drive the PDP.

It is further an object of the present invention to provide a PDP and a method of driving the same where each of the sustain discharge pulses in the sustain discharge period produces stable discharges.

These and other objects can be achieved by a method of driving a plasma display panel (PDP) that includes providing a plurality of X electrodes and a plurality of Y electrodes extending in a first direction, a plurality of A electrodes arranged between the X electrode and the Y electrode and extending in a second direction that crosses the plurality of X electrodes and the plurality of Y electrodes, and a plurality of discharge cells arranged in a region where the A electrodes cross the X electrodes and the Y electrodes and applying a pulse waveform voltage alternating between a low level voltage and a high level voltage to the X electrodes and applying a pulse waveform voltage alternating between the high level voltage and the low level voltage to the Y electrodes during a sustain discharge period when sustain discharging occurs in selected ones of the plurality of discharge cells, wherein a pulse width of a first high level voltage applied to the X electrodes in the sustain discharge period is larger that pulse widths of all other high level voltage pulses applied during the sustain discharge period.

During the sustain discharge period, except for the first high level voltage applied to-the X electrodes, each of the high level voltages applied to the X electrodes and to the Y electrodes can have equal pulse widths. The method can also include applying a first voltage that is higher than a ground voltage to the plurality of X electrodes during an address period, applying an address pulse voltage of a positive voltage to selected ones of said plurality of A electrodes during said address period and applying a scan pulse having a negative voltage to the plurality of Y electrodes during said address period, wherein the address period occurs prior to the sustain discharge period, the address period being adapted to select ones of said plurality of discharge cells for discharge during the sustain discharge period. The method can further include applying a rising ramp type waveform voltage and a falling ramp type waveform voltage to the Y electrodes during a reset period, applying a ground voltage to the selected A electrodes during the reset period and applying a step type waveform voltage that rises from the ground voltage to the first voltage to the plurality of X electrodes when the falling ramp type voltage is applied to the Y electrodes during the reset period, the reset period occurring before the address period, the reset period being adapted to initialize each of the discharge cells.

According to another aspect of the present invention, there is provided a method of driving a PDP that includes providing a plurality of X electrodes and a plurality of Y electrodes extending in a first direction, a plurality of A electrodes arranged between the X electrode and the Y electrode and extending in a second direction that crosses the plurality of X electrodes and the plurality of Y electrodes, and a plurality of discharge cells arranged in a region where the A electrodes cross the X electrodes and the Y electrodes and applying a pulse waveform voltage alternating between a low level voltage and a high level voltage to the X electrodes and applying a pulse waveform voltage alternating between the high level voltage and the low level voltage to the Y electrodes during a sustain discharge period when sustain discharging occurs in selected ones of the plurality of discharge cells, wherein a high level voltage of a second sustain discharge in the sustain discharge period has a higher electric potential than all other high level voltages applied to the X electrodes and to the Y electrodes during the sustain discharge period.

The high level voltage applied during the second sustain discharge of the sustain discharge period can be applied to one of the X electrodes and except for the second sustain discharge of the sustain discharge period, a magnitude of each of the high level voltages applied during the sustain discharge period can be equal. The method can also include applying a first voltage that is higher than a ground voltage to the plurality of X electrodes during an address period, applying an address pulse voltage of a positive voltage to selected ones of said plurality of A electrodes during said address period and applying a scan pulse having a negative voltage to the plurality of Y electrodes during said address period, wherein the address period occurs prior to the sustain discharge period, the address period being adapted to select ones of said plurality of discharge cells for discharge during the sustain discharge period. The method can further include applying a rising ramp type waveform voltage and a falling ramp type waveform voltage to the Y electrodes during a reset period, applying a ground voltage to the selected A electrodes during the reset period and applying a step type waveform voltage that rises from the ground voltage to the first voltage to the plurality of X electrodes when the falling ramp type voltage is applied to the Y electrodes during the reset period, the reset period occurring before the address period, the reset period being adapted to initialize each of the discharge cells.

According to yet another aspect of the present invention, there is provided a method of driving a PDP that includes providing a plurality of X electrodes and a plurality of Y electrodes extending in a first direction, a plurality of A electrodes arranged between the X electrode and the Y electrode and extending in a second direction that crosses the plurality of X electrodes and the plurality of Y electrodes, and a plurality of discharge cells arranged in a region where the A electrodes cross the X electrodes and the Y electrodes and applying a pulse waveform voltage alternating between a low level voltage and a high level voltage to the X electrodes and applying a pulse waveform voltage alternating between the high level voltage and the low level voltage to the Y electrodes during a sustain discharge period when sustain discharging occurs in selected ones of the plurality of discharge cells, wherein a low level voltage applied during the second sustain discharge in the sustain discharge period has a lower electric potential than all other low level voltages applied to the X electrodes and to the Y electrodes during the sustain discharge period.

The method can also include applying a first voltage that is higher than a ground voltage to the plurality of X electrodes during an address period, applying an address pulse voltage of a positive voltage to selected ones of said plurality of A electrodes during said address period and applying a scan pulse having a negative voltage to the plurality of Y electrodes during said address period, wherein the address period occurs prior to the sustain discharge period, the address period being adapted to select ones of said plurality of discharge cells for discharge during the sustain discharge period. The method can further include applying a rising ramp type waveform voltage and a falling ramp type waveform voltage to the Y electrodes during a reset period, applying a ground voltage to the selected A electrodes during the reset period and applying a step type waveform voltage that rises from the ground voltage to the first voltage to the plurality of X electrodes when the falling ramp type voltage is applied to the Y electrodes during the reset period, the reset period occurring before the address period, the reset period being adapted to initialize each of the discharge cells.

According to still another aspect of the present invention, there is provided a PDP that includes a front substrate and a rear substrate spaced apart from each other, a plurality of barrier ribs partitioning a space between the front substrate and the rear substrate into a plurality of discharge cells, a plurality of X electrodes and a plurality of Y electrodes arranged within the plurality of barrier ribs and extending in a first direction, a plurality of A electrodes arranged between the plurality of X electrodes and the plurality of Y electrodes and extending in a second direction that crosses the plurality of X electrodes and the plurality of Y electrodes and a phosphor layer arranged within the plurality of discharge cells, wherein the PDP is driven by applying a pulse waveform voltage alternating between a low level voltage and a high level voltage to the X electrodes and applying a pulse waveform voltage alternating between the high level voltage and the low level voltage to the Y electrodes during a sustain discharge period when sustain discharging occurs in selected ones of the plurality of discharge cells, and the PDP is driven by applying a longer pulse width for a first high level voltage applied to the X electrode in the sustain discharge period than all other high level voltage pulse widths applied during the sustain discharge period, or by applying a higher electric potential for a high level voltage during a second sustain discharge in the sustain discharge period than all other high level voltages applied to the X electrodes and to the Y electrodes during the sustain discharge period, or by applying lower electric potential for a low level voltage during the second sustain discharge in the sustain discharge period than all other low level voltages applied to the X electrodes and to the Y electrodes during the sustain discharge period.

The plurality of X electrodes, the plurality of A electrodes, and the plurality of Y electrodes can be arranged to surround ones of the plurality of discharge cells. The plurality of X electrodes, the plurality of A electrodes, and the plurality of Y electrodes can be sequentially arranged from a front to a rear of the plurality of barrier ribs. The plurality of Y electrodes, the plurality of A electrodes, and the plurality of X electrodes can be sequentially arranged from the front to the rear of the barrier ribs. The phosphor layer can be arranged on a surface of the front substrate facing the rear substrate. The phosphor layer can be arranged on a surface of the rear substrate facing the front substrate.

BRIEF DESCRIPTION OF THE DRAWINGS

A more complete appreciation of the invention and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
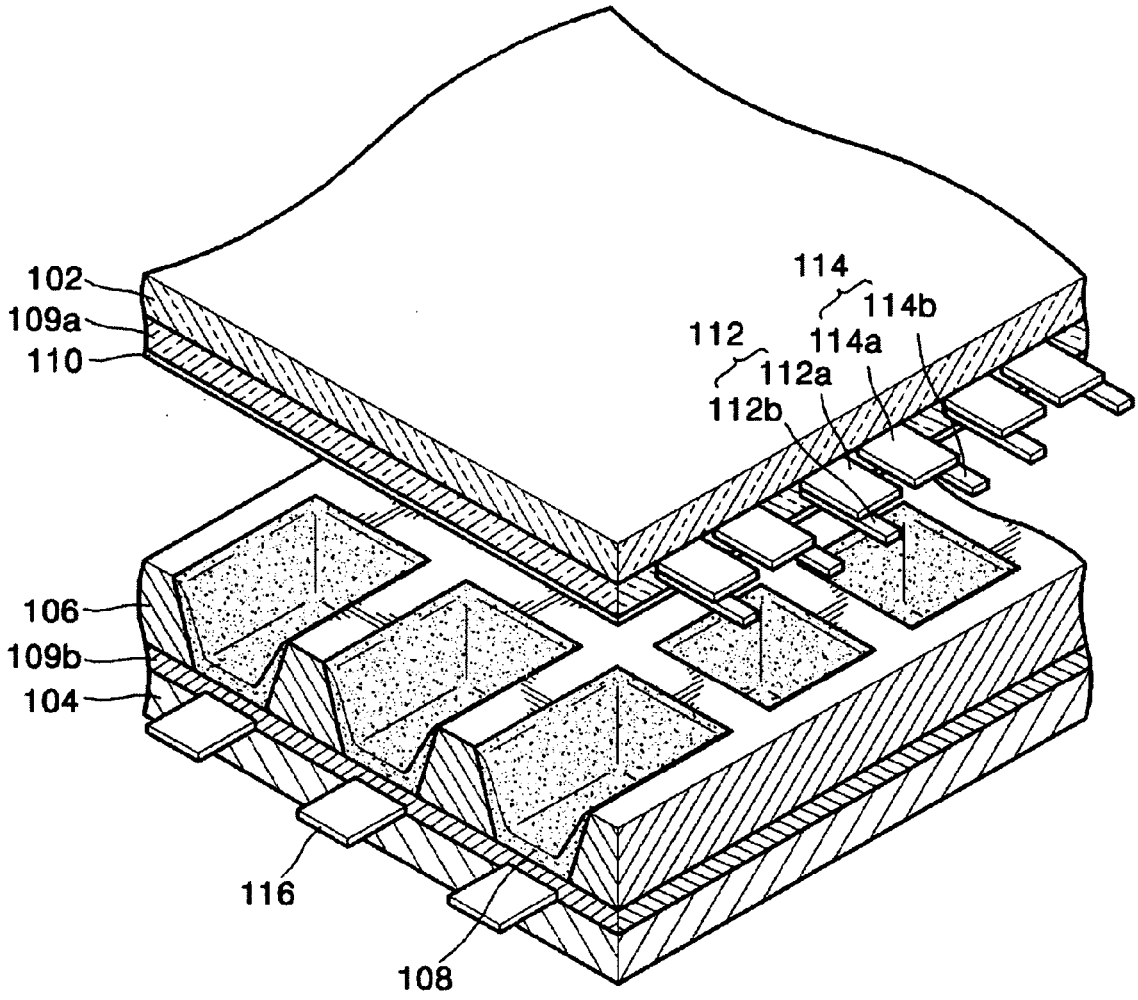
FIG. 1 is a partially exploded perspective view of a plasma display panel (PDP)

Turning now to the figures, FIG. 1 is a partially exploded perspective view of a PDP. Referring to FIG. 1, the PDP has a front panel and a rear panel. The front panel includes a front substrate 102, a plurality of common electrodes 112 each including a transparent electrode 112*a* and a bus electrode 112*b*, a plurality of scan electrodes 114 each including a transparent electrode 114*a* and a bus electrode 114*b*, a dielectric layer 109*a*, and a protection layer 110. The rear panel includes a rear substrate 104, a plurality of address electrodes 116, a dielectric layer 109*b*, a plurality of barrier ribs 106, and a phosphor layer 108. The front substrate 102 and rear substrate 104 are spaced apart from each other and face each other. A space between the front and rear substrates 102 and 104 is partitioned by the barrier ribs 106 into a plurality of discharge cells. A dielectric substance is included near the discharge cells to achieve a panel capacitance. The discharge cells can be similarly formed using the panel capacitance and a panel capacitor combined with electrodes surrounding the discharge cells.

Figure 2:
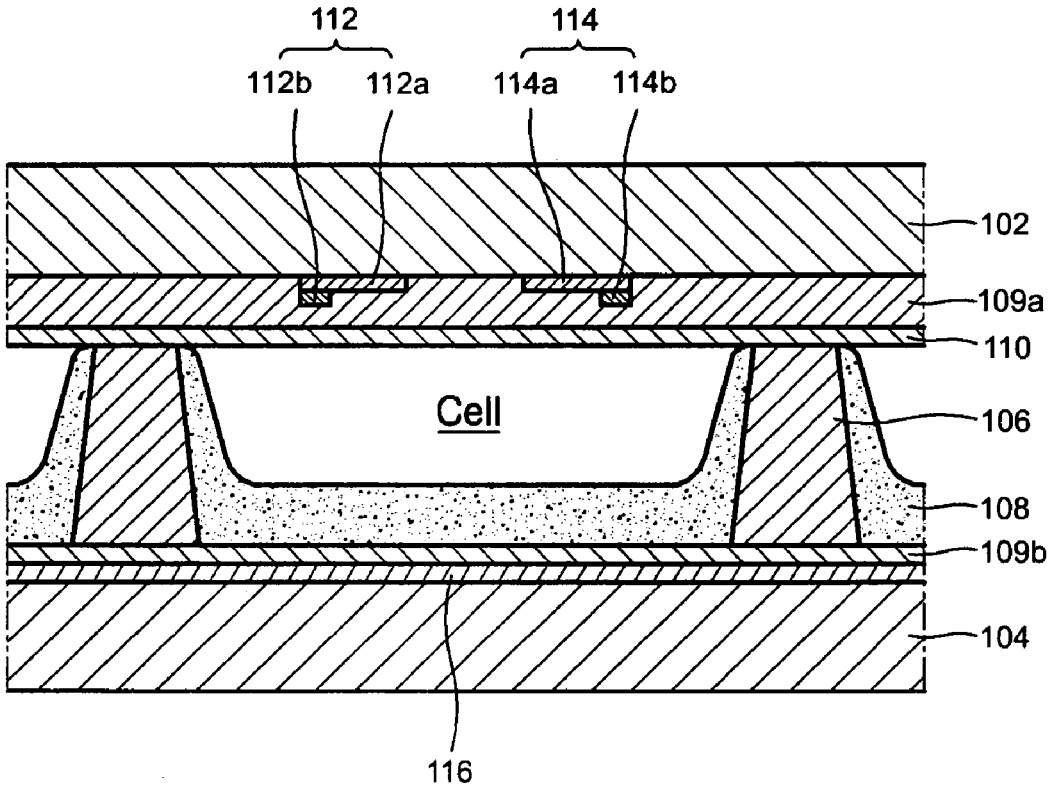
FIG. 2 is a cross-sectional view showing the structure of a discharge cell of the PDP of FIG. 1.

FIG. 2 is a cross-sectional view of the structure of a discharge cell of the PDP of FIG. 1. Referring to FIG. 2, a front substrate 102, a rear substrate 104, barrier ribs 106, a phosphor layer 108, dielectric layers 109*a* and 109*b*, protection layer 110, common electrodes 112, 112*a*, and 112*b*, scan electrodes 114, 114*a*, and 114*b*, and address electrodes 116 are shown in a cross section.

Figure 3:
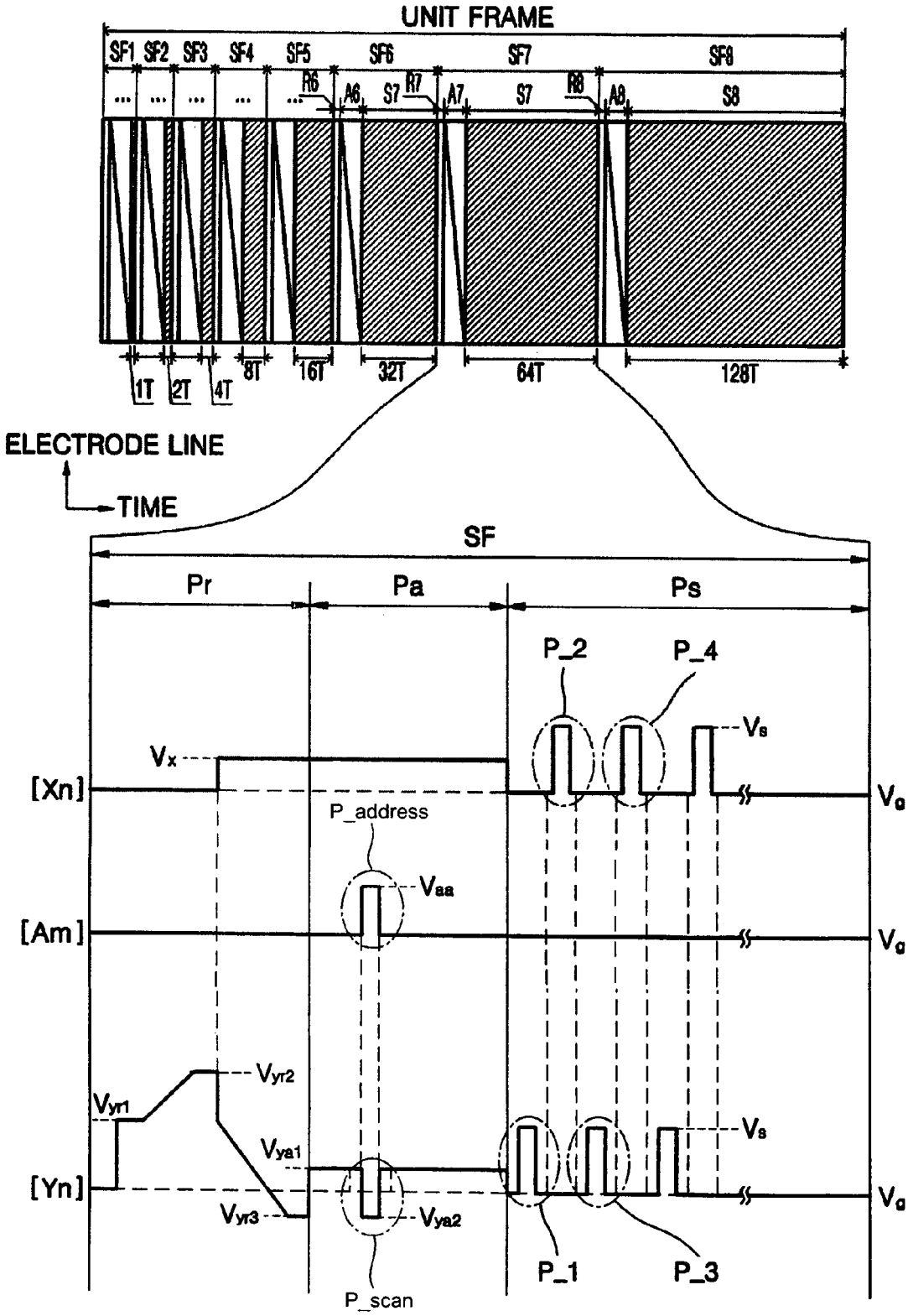
FIG. 3 is a timing diagram of a part of driving waveform voltages applied to common electrodes, scan electrodes, and address electrodes of the PDP illustrated in FIGS. 1 and 2.

Turning now to FIG. 3, FIG. 3 is a timing diagram of a part of driving waveform voltages applied to the common electrodes, the scan electrodes, and the address electrodes of the PDP illustrated in FIGS. 1 and 2. An address display separation (ADS) scheme is a method of driving a PDP. A unit frame is divided into a plurality of sub-fields SF to display an image on the PDP. Each of the sub-fields SF includes a reset period Pr, an address period Pa, and a sustain discharge period Ps. In each of these three periods, different driving waveform voltages are applied to each of the common electrodes, the scan electrodes, and the address electrodes of FIGS. 1 and 2. In the reset period Pr, a ramp type reset pulse voltage is applied to a scan electrode Yn. In the address period Pa, a scan pulse voltage P_scan is applied to a scan electrode Yn and an address pulse voltage P_address is applied to an address electrode Am. In a sustain discharge period Ps, sustain pulse voltages P_1, P_2, P_3, and P_4 are alternately applied to a common electrode Xn and the scan electrode Yn.

The PDP of FIGS. 1 and 2 has low optical transmission characteristics (only about 60%) with regard to visible rays passing through the front substrate, since the visible rays generated by exciting the phosphor must pass through a pair of sustain discharge electrodes 112, 114, the dielectric layer 109*a*, and the protection layer 110 of the front substrate 102 in order to pass through the front substrate 102. The PDP of FIGS. 1 and 2 also has low light-emitting efficiency since the pair of sustain discharge electrodes 112, 114 are disposed in the front of the discharge cells including the front and rear sides thereof. A sustain discharge between the pair of sustain discharge electrodes 112, 114 occurs only at the front of the discharge cells, so that the discharge space is not efficiently used. Also, charged particles generated by the sustain discharge occurring at the front of the discharge cells ion-sputter the phosphor layer at the rear of the discharge cell, causing a permanent afterimage.

To solve the above problems, a PDP has been developed that has an improved structure in which the pair of sustain discharge electrodes disposed in the front of the discharge cell is disposed on a barrier rib forming the sides of the discharge cell. However, the PDP having the improved structure has a different electrode structure from the PDP illustrated in FIGS. 1 and 2. Therefore, unexpected problems may occur when the driving waveform voltages illustrated in FIG. 3 are applied to such a structure. Therefore, what is needed is an improved structure for a plasma display device and improved waveforms for driving the electrodes of the improved plasma display device that overcomes these problems.

Turning now to FIGS. 4A through 4D, FIGS. 4A through 4D are cross-sectional views of the structure of a discharge cell included in a plasma display panel (PDP) having an improved structure according to an embodiment of the present invention. Referring to FIGS. 4A through 4D, the PDP having the improved structure includes a front substrate 402, a rear substrate 404, barrier ribs 406, a phosphor layer 408, a protection layer 410, common electrodes or X electrodes 412 Xn, scan electrodes or Y electrodes 414 Yn, and address electrodes or A electrodes 416 Am.

The space between the front substrate 402 and the rear substrate 404 is divided by barrier ribs 406 into unit discharge cells where discharges occur. Each discharge cell includes a front side (a front substrate side), a rear side (a rear substrate side), and barrier rib sides. The X electrodes 412, the A electrodes 416, and the Y electrodes 414 of the PDP having the improved structure are disposed within the barrier ribs located between the discharge cells.

Since the front substrate 402 is disposed in a front panel of the PDP, the discharge cell having the structure as illustrated in FIGS. 4A through 4D has a good optical transmissivity of visible rays. Since the electrodes 412, 414, and 416 are disposed within the barrier ribs between the discharge cells, the discharge space of the discharge cells can be efficiently used, thus increasing light-emitting efficiency. Further, since the phosphor layer 408 in each case of FIGS. 4A through 4D is not located between any of the electrodes, the electric field produced by charged particles which are created by a sustain discharge between the pair of the sustain discharge electrodes 412 and 414 does not damage the phosphor layer 408, thus reducing ion-sputtering.

Figure 4A:
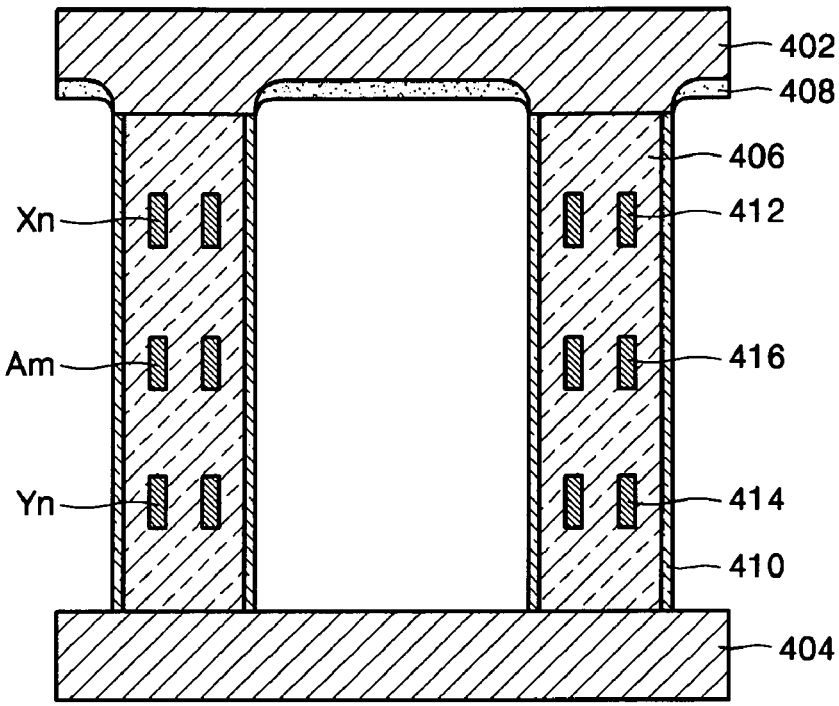
FIGS. 4A through 4D are cross-sectional views of the structures of a discharge cell included in a PDP having improved structures according to an embodiment of the present invention.
Figure 4B:
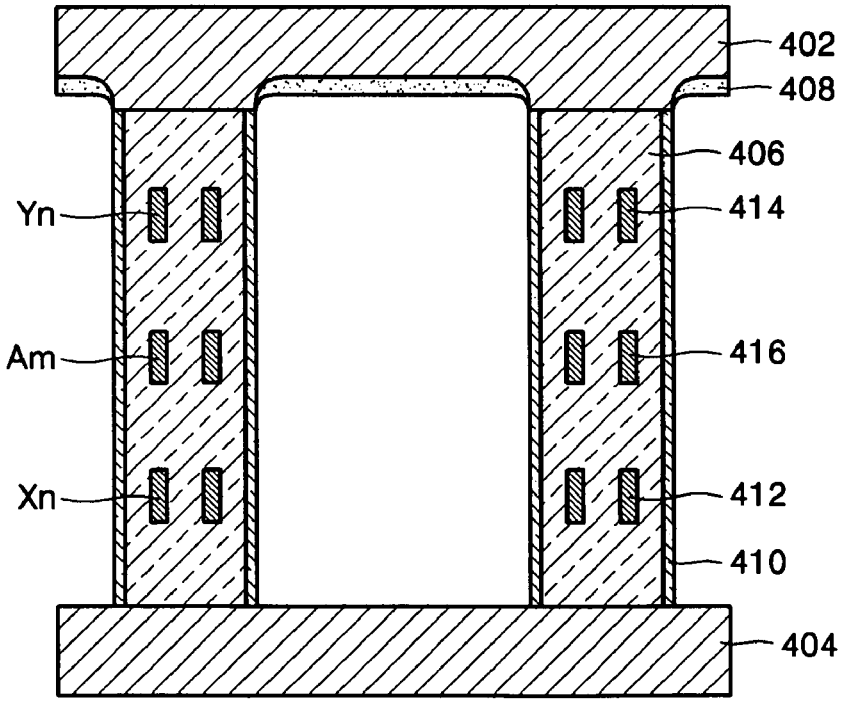
Figure 4C:
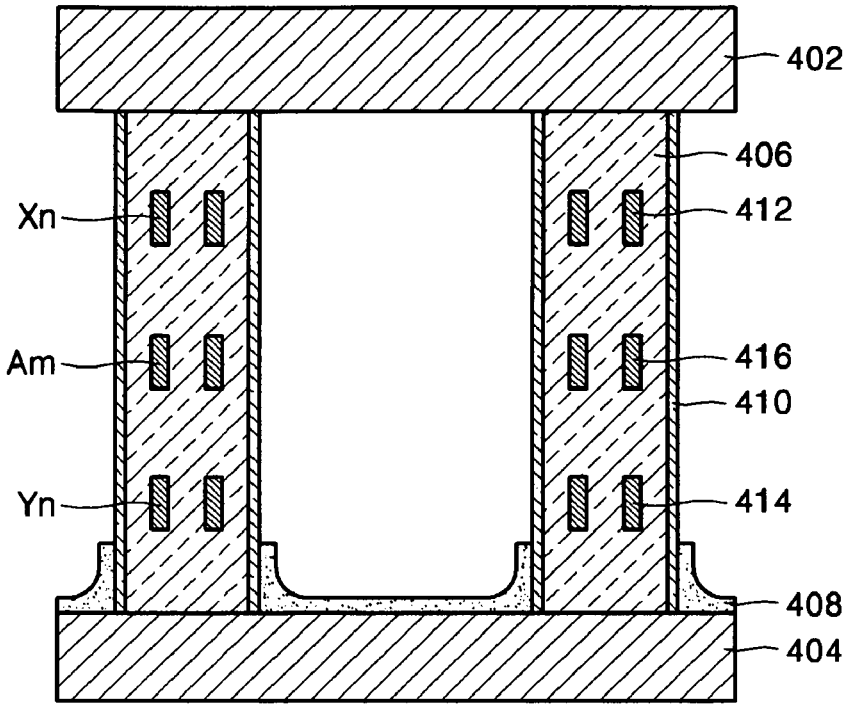
Figure 4D:
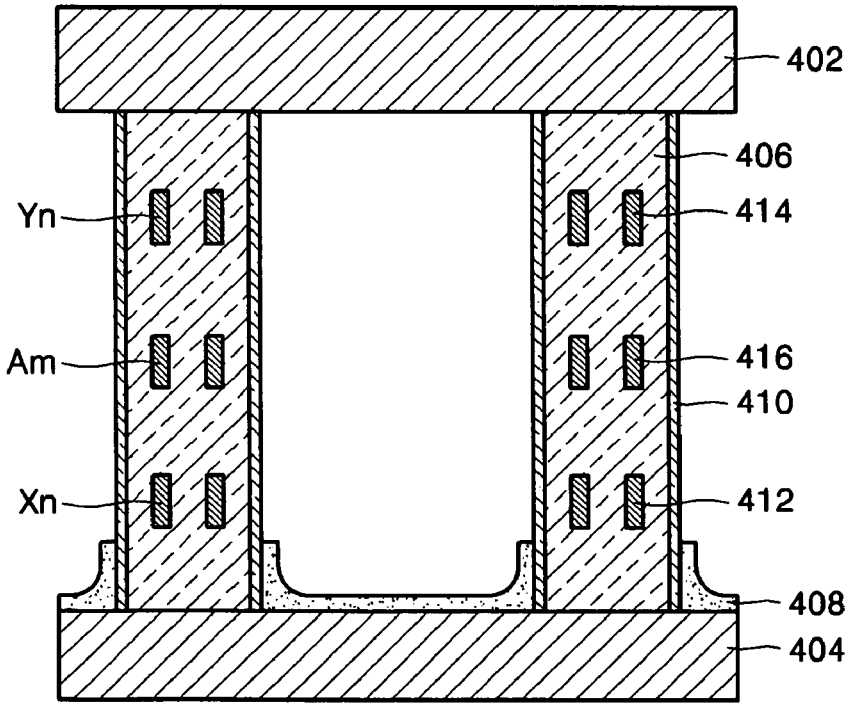

The PDPs of FIGS. 4A through 4D vary according to 1) the relative positioning of the X, Y and A electrodes as well as 2) the location of the phosphor layer 408. In FIGS. 4A and 4C, the X electrodes are situated closer to the front substrate 402 than either the A or the Y electrodes, and the Y electrodes are situated closer to the rear substrate 404 than either of the X and the A electrodes and the A electrode is located between the X and the Y electrode. In FIGS. 4B and 4D, the X electrode is situated closer to the rear substrate 404 than either the A or the Y electrodes, and the Y electrode is situated closer to the front substrate 402 than either of the X and the A electrodes and the A electrode is located between the X and the Y electrode. In FIGS. 4A and 4B, the phosphor layer 408 is located on the front substrate 402 while in FIGS. 4C and 4D, the phosphor layer 408 is located on the rear substrate 404.

Since discharge gas (pressure below about 0.5 atmospheres) is charged within the discharge cells, discharge gas particles collide with charges due to an electric field produced by driving voltages applied to each of the electrodes of the discharge cells, which results in a plasma discharge, thus producing vacuum ultraviolet radiation. The discharge gas is a mixture of xenon (Xe) and one or two among neon (Ne), helium (He), and argon (Ar).

The barrier ribs 406 partition the space between front substrate 402 and rear substrate 404 into a plurality of discharge cells, each discharge cell being a basic unit of an image. The barrier ribs 406 serve to prevent cross talk between adjoining discharge cells.

A dielectric substance may be formed on the barrier ribs 406 or the barrier ribs can be made out of a dielectric substance. The dielectric substance is used as an insulation coating film for the X electrodes 412, the A electrodes 416, and the Y electrodes 414 situated within the barrier ribs 406. Some charges produced by a discharge are accumulated on the protection layer 410 over the dielectric substance by electro magnetism according to polarities of voltages applied to each of the electrodes, thus forming wall charges. A wall charge voltage produced by the wall charges can be added to driving voltages applied to each of the electrodes in order to determine an electric field present within the discharge space of the discharge cells. A stable discharge can occur only when the electric filed within the discharge cell is sufficient.

The barrier ribs 406 can be manufactured to separately include the dielectric substance used as the insulation coating film of each of the electrodes. To be more specific, the PDP having the improved structure includes barrier ribs 406 either made out of a dielectric substance or containing a separate dielectric layer.

A photoluminescence (PL) mechanism, which emits visible rays upon being excited by vacuum ultra violet (VUV) light produced by the discharge, occurs in the phosphor layers 408. The phosphor layers 408 includes red light-emitting phosphor layers, green light-emitting phosphor layers, and blue light-emitting phosphor layers so that the PDP can realize a visible color image. These three colored phosphor layers are disposed within the discharge cells to form unit pixels. The red light-emitting phosphor layers contain $(Y,Gd)BO_3:Eu^{3+}$, etc., the green light-emitting phosphor layers contain $Zn_2SiO_4:Mn^{2+}$, etc., and the blue light-emitting phosphor layers contain $BaMgAl_{10}O_{17}:Eu^{2+}$, etc.

The protection layer 410 protects the dielectric substance or the dielectric layer associated with the barrier ribs and allows the discharge to occur more easily by increasing the emission of secondary electrons. The protection layer 410 is formed of magnesium oxide (MgO), etc.

A side section obtained by cutting the discharge cells of the PDP having the improved structure parallel to the front side and the rear side and perpendicular to the sides of the barrier ribs can result in the shape of a circle or polygon such as a tetragon, a hexagon or an octagon, etc. A circular shaped side section of the discharge cells indicates that the discharge cells have a cylindrical shape. A polygonal shaped side section of the discharge cell indicates that the discharge cells have a hexahedron shape. The cylindrical shape is more advantageous than the hexahedron shape in terms of the discharge efficiency since the cylindrical shape can more efficiently use the discharge space within the discharge cells than the hexahedron shape.

Figure 4E:
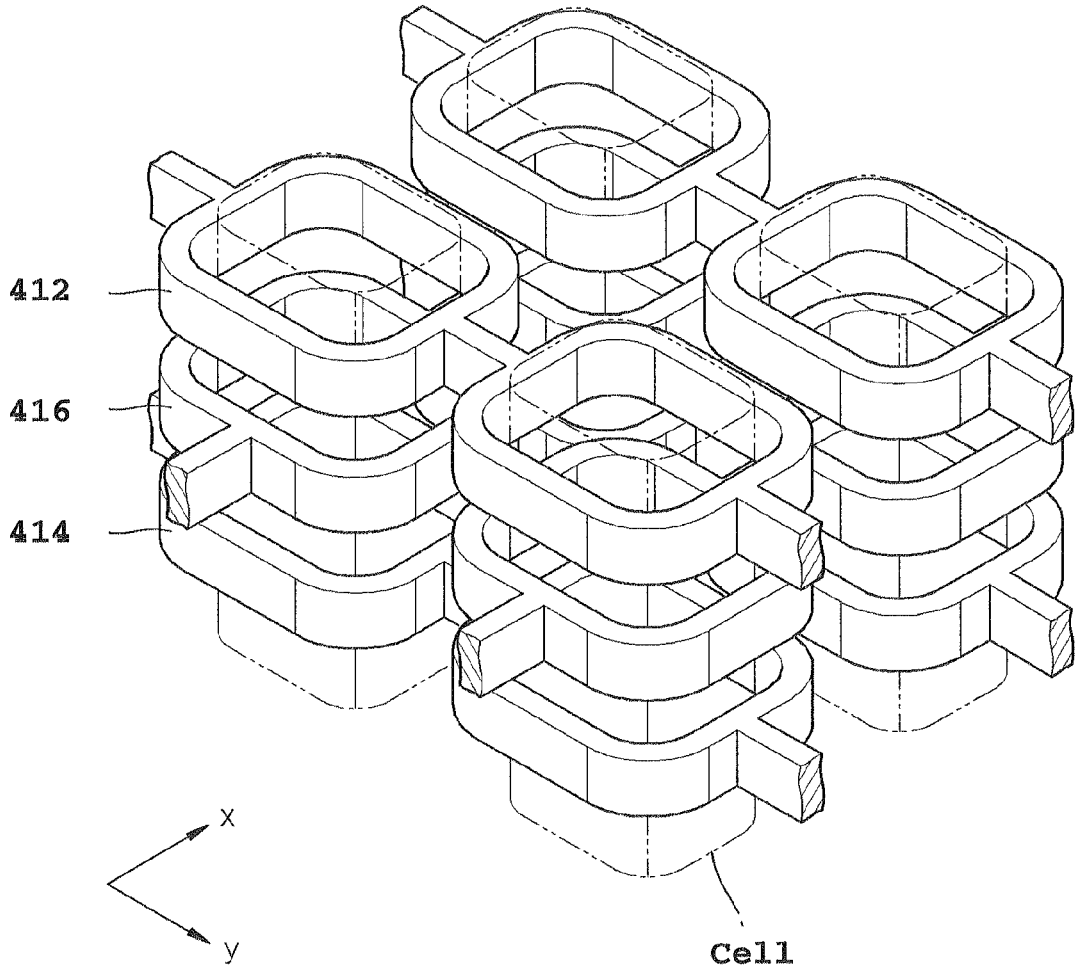
FIG. 4E is a view of an extension direction of the X, Y and A electrodes of FIGS. 4A and 4C.

Turning now to FIG. 4E, FIG. 4E is a view of the X electrodes 412, the A (address) electrodes 416 and the Y (scan) electrodes 414 of FIGS. 4A and 4C. As illustrated in FIG. 4E, the X electrodes 412 and the Y electrodes 414 extend in a one direction (y direction) and the A electrodes 416 extend in another (x) direction that crosses the X electrodes 412 and the Y electrodes 414, the A electrodes 414 being arranged between the X electrodes 412 and the Y electrodes 416. The arrangement of FIGS. 4B and 4D can be realized by substituting 414 for 412 in FIG. 4E and substituting 412 for 414 in FIG. 4E.

Figure 5:
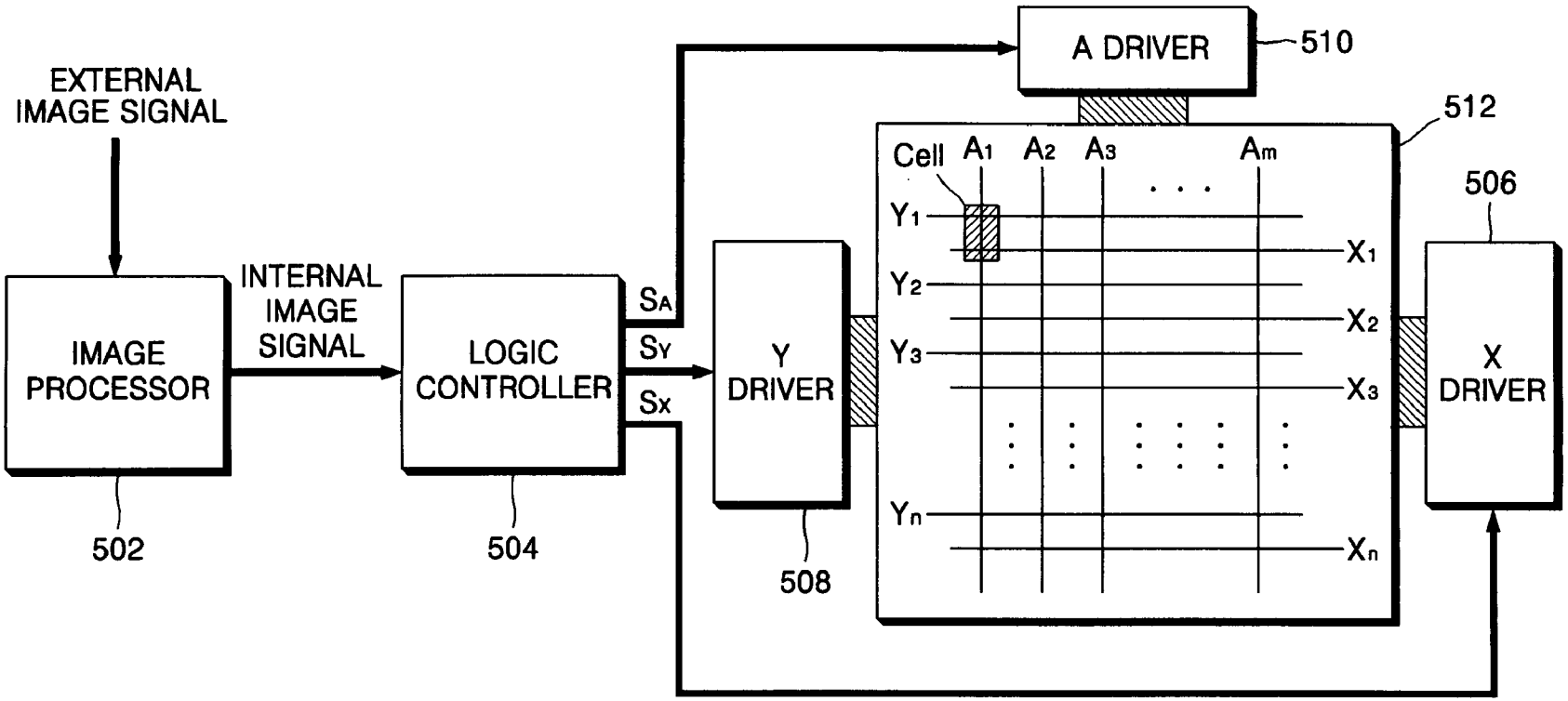
FIG. 5 is a block diagram of an apparatus for driving the PDP according to an embodiment of the present invention.

Turning now to FIG. 5, FIG. 5 is a block diagram of an apparatus for driving the PDP according to an embodiment of the present invention. Referring to FIG. 5, the apparatus for driving the PDP includes an image processor 502, a logic controller 504, an X electrode driver 506, a Y electrode driver 508, and an A electrode driver 510.

The apparatus further includes a plasma display panel 512 in which a plurality of X electrodes $X_1$-Xn, a plurality of Y electrodes $Y_1$-Yn, and a plurality of A electrodes $A_1$-Am are disposed to cross each other. The X electrodes Xn and the Y electrodes Yn are parallel to each other. However, strictly speaking, the X electrodes $X_1$-Xn and the Y electrodes $Y_1$-Yn are vertically (based on the surface) displaced from each other, which can be seen in FIGS. 4A through 4D.

The image processor 502 converts an external analog image signal, such as a PC signal, a DVD signal, a video signal, a TV signal, etc. into a digital signal. Image processor 502 image-processes the converted digital signal, generates an internal image signal, and transmits the generated internal image signal to the logic controller 504. The internal image signal includes red (R), green (G), and blue (B) image data, a clock signal, and vertical and horizontal synchronization signals.

The logic controller 504 generates an X electrode driver control signals $S_X$, a Y electrode driver control signals $S_Y$ and an A electrode driver control signals $S_A$ by processing a gamma correction, which is an automatic power control (APC) for the internal image signal received from the image processor 502. The generated X electrode driver control signals $S_X$, Y electrode driver control signals $S_Y$, and A electrode driver control signals $S_A$ are transmitted to the X electrode driver 506, the Y electrode driver 508, and the A electrode driver 510, respectively.

The X electrode driver 506 receives the X electrode driver control signals $S_X$ from the logic controller 504, outputs an X electrode driver driving signals, and applies the X electrode driving voltages to the X electrodes $X_1$-Xn of the PDP. The Y electrode driver 508 receives the Y electrode driver control signals $S_Y$ from the logic controller 504, outputs the Y electrode driver driving signals, and applies Y electrode driving voltages to the Y electrodes $Y_1$-Yn of the PDP. The A electrode driver 510 receives the A electrode driver control signals $S_A$ from the logic controller 504, outputs A electrode driver driving signals, and applies A electrode driving voltages to the A electrodes $A_1$-Am of the PDP.

The plasma display panel 512 includes the X electrodes $X_1$-Xn, the Y electrodes $Y_1$-Yn, and the A electrodes $A_1$-Am which are disposed to overlap each other. The plasma display panel 512 displays an image corresponding to an external image signal input to a plasma display device. The image is displayed by visible rays produced in the discharge cells by applying the X, Y, and A electrode driving voltages to the X, Y, and A electrodes Xn, Yn, and Am, respectively. Driving waveform voltages, which are applied to each of the X1 Y1 and A electrodes $X_1$-Xn, $Y_1$-Yn, and $A_1$-Am of the PDP 512, will later be described with reference to FIGS. 7A, 7B, and 9.

Turning now to FIGS. 6A through 6D, FIGS. 6A through 6D illustrate distributions of wall charges accumulated at different points in time in the sub-field by applying the driving waveform voltages illustrated in FIG. 3 to the PDP having the improved structure of FIGS. 4A through 4D. Distributions of wall charges of FIGS. 6A through 6D will now be described with reference to FIG. 3.

Figure 6A:
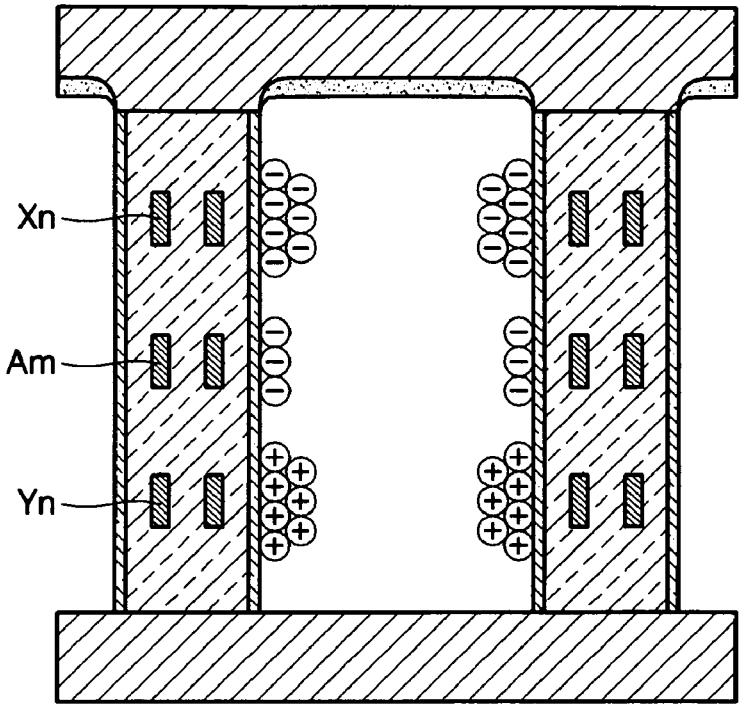
FIGS. 6A through 6D illustrate distributions of wall charges accumulated by applying driving waveform voltages illustrated in FIG. 3 to the PDP having the improved structures illustrated in FIGS. 4A through 4D.

FIG. 6A illustrates a distribution of wall charges around each of the electrodes at the end of an address period (at the end of $P_A$). In the address period, an X electrode first voltage Vx is applied to the X electrodes Xn. A waveform scan pulse voltage is applied to the Y electrodes, the pulse varying from $V_{ya1}$ to $V_{ya2}$ during a ramp up, a Y electrode address second voltage $V_{ya2}$ having a higher electric potential than the Y electrode address first voltage $V_{ya1}$previously established, $V_{ya1}$ being less than Vs applied in the sustain discharge period. A waveform address pulse voltage that varies from ground voltage Vg to Vaa, which is higher voltage than the ground voltage Vg previously established, is applied to the A electrodes Am during the address period.

The voltages applied to each of the electrodes are added to a wall charges accumulated around the each of the electrodes at the end of a reset period (at the end of Pr) to determine the electric field present in the discharge space of the discharge cells. As a result, an address discharge is generated between the Y electrodes Yn and the A electrodes Am during address period $P_a$. Charges produced by the discharge are accumulated around the electrodes to which a voltage having an opposite polarity is applied to form wall charges as illustrated in FIG. 6A. This results in a large quantity of negative wall charges formed around the X electrodes Xn, a small quantity of negative wall charges formed around the A electrodes Am, and a large quantity of positive wall charges formed around the Y electrodes Yn.

Figure 6B:
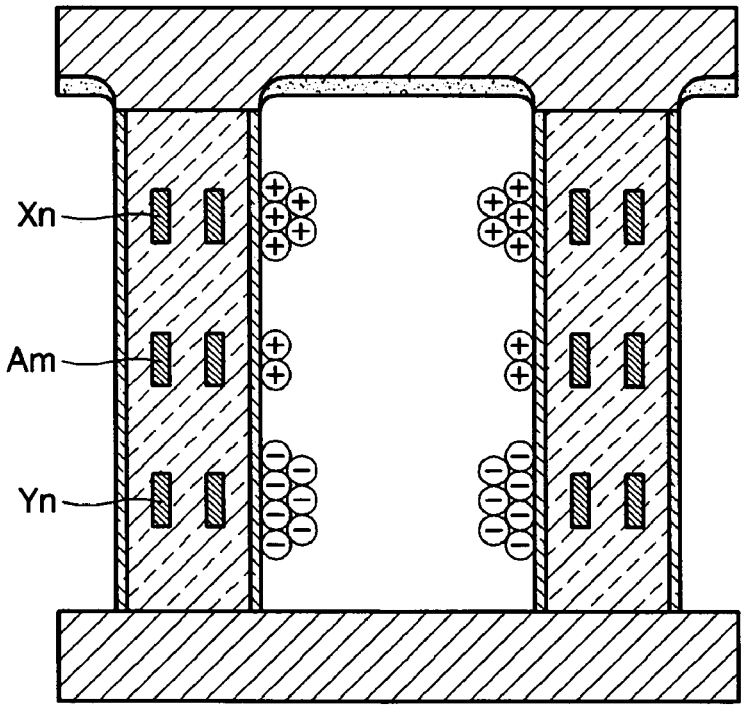

Turning now to FIG. 6B, FIG. 6B illustrates a distribution of wall charges around each of the electrodes at the end of a first sustain discharge in the sustain discharge period Ps. In a first sustain discharge (first pulse applied to either the X or the Y electrodes) of a sustain discharge period Ps, the ground voltage Vg is applied to the X electrodes Xn, a sustain discharge voltage Vs is applied to the Y electrodes Yn which are oppose to the X electrodes Xn, and the ground voltage Vg is applied to the A electrodes Am.

The voltages applied to each of the electrodes are added to a wall charge voltage accumulated around each of the corresponding electrodes at the end of the address period (at the end of Pa) to determine the electric field present in the discharge spaces of the discharge cells. As a result, an address discharge between the Y electrodes Yn and the A electrodes Am results in a first sustain discharge between the X electrodes Xn and the Y electrodes Yn. Charges generated by the first sustain discharge are accumulated around each of the electrodes and have a polarity that is opposite to the voltages applied thereto. This results in positive wall charges being formed around the X electrodes Xn, a small quantity of positive wall charges being formed around the A electrodes Am, and a large quantity of negative wall charges being formed around the Y electrodes Yn at this point of time in the sustain discharge period.

However, with the waveforms illustrated in FIG. 3 applied to the structures of FIGS. 4A through 4D, a sustain waveform pulse voltage that generates the first sustain discharge can not successfully generate subsequent sustain discharges because of the quantity of wall charges accumulated at the end of the first sustain discharge. The sustain discharges after a second sustain discharge in a sustain discharge period are essentially discharges between the X electrodes Xn and the Y electrodes Yn along with a weak start discharge generated using the A electrodes Am. For the second discharge P_2 in FIG. 3, the sustain discharge voltage Vs is applied to the X electrodes Xn and the ground voltage Vg is applied to the Y electrodes Yn while wall charges are present from the end of the first sustain discharge. With such a scenario, a stable second sustain discharge P_2 between the X electrodes Xn and the Y electrodes Yn can not be guaranteed. Such an unstable second sustain discharge results in all of the remaining discharges in the sub-field also being unstable. Because of this, it is necessary to modify the waveforms of FIG. 3 so that the structures of FIGS. 4A through 4D will not produce unstable discharges. To remove the unstable effect and generate only stable sustain discharges, a stronger electric field than before is required between the X electrodes Xn and the Y electrodes Yn during the second and subsequent sustain discharges.

Figure 6C:
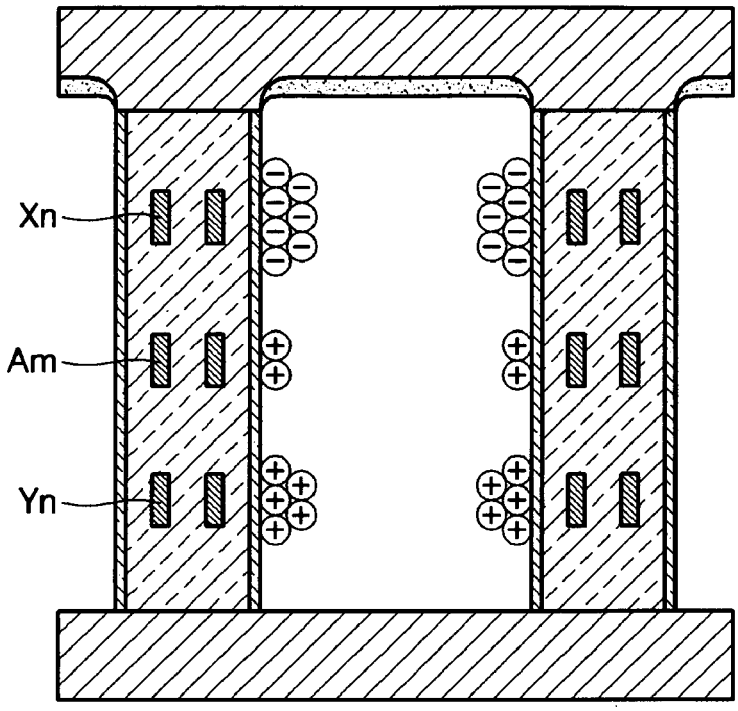
Figure 6D:
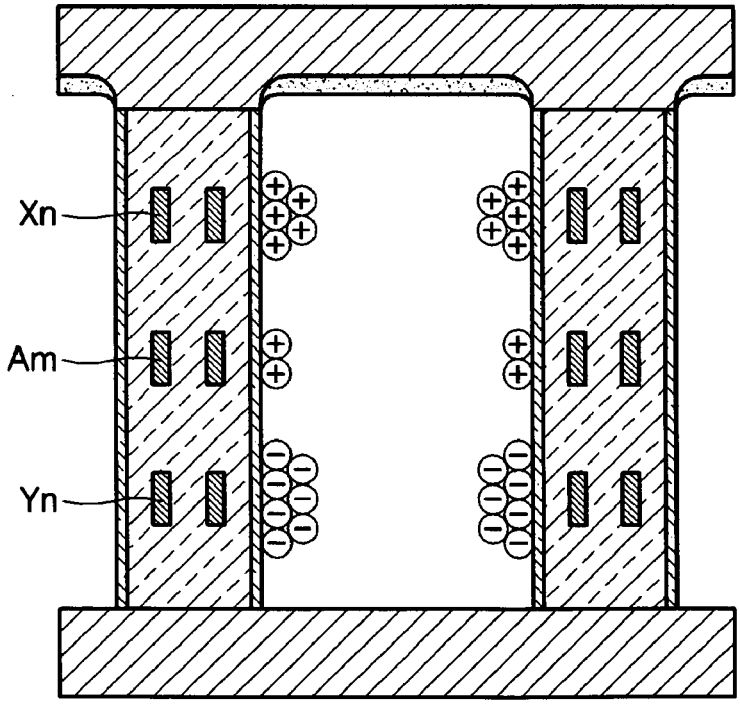

Turning now to FIGS. 6C and 6D, FIG. 6C illustrates a distribution of wall charges around each of the electrodes at the end of the second sustain discharge in the sustain discharge period Ps, and FIG. 6D illustrates a distribution of wall charges around each of the electrodes at the end of the third sustain discharge in the sustain discharge period Ps when the waveforms of FIG. 3 are applied to the structures of FIGS. 4A through 4D. The second sustain discharge is generated without forming a sufficiently strong electric field between the X electrodes Xn and the Y electrodes Yn. This insufficient electric field during the second sustain discharge pulse does not guarantee a stable second sustain discharge between the X electrodes Xn and the Y electrodes Yn, and results in a chain reaction in that all of the subsequent discharges also can be unstable because the electric field is insufficient because of insufficient wall charges present. This chain reaction occurs because a weak or unstable discharge leaves behind insufficient wall charges for the next sustain discharge pulse.

To be more specific, if the driving voltages as illustrated in FIG. 3 are applied to the X electrodes Xn and the Y electrodes Yn when the wall charges as illustrated in FIG. 6B are present, the second sustain discharge becomes unstable and the wall charges remaining after this unstable discharge P_2 are insufficient for the third discharge P_3. Similarly, when the driving voltage as illustrated in FIG. 3 are applied to the X electrodes Xn and the Y electrodes Yn when the wall charges present are as illustrated in FIG. 6C, the third sustain discharge also becomes unstable, and the wall charges present after the unstable third sustain discharge, as illustrated in FIG. 6D, is also insufficient to produce a stable discharge when pulse P_4 of FIG. 3 is applied to the X and the Y electrodes of FIGS. 4A through 4D.

Figure 7A:
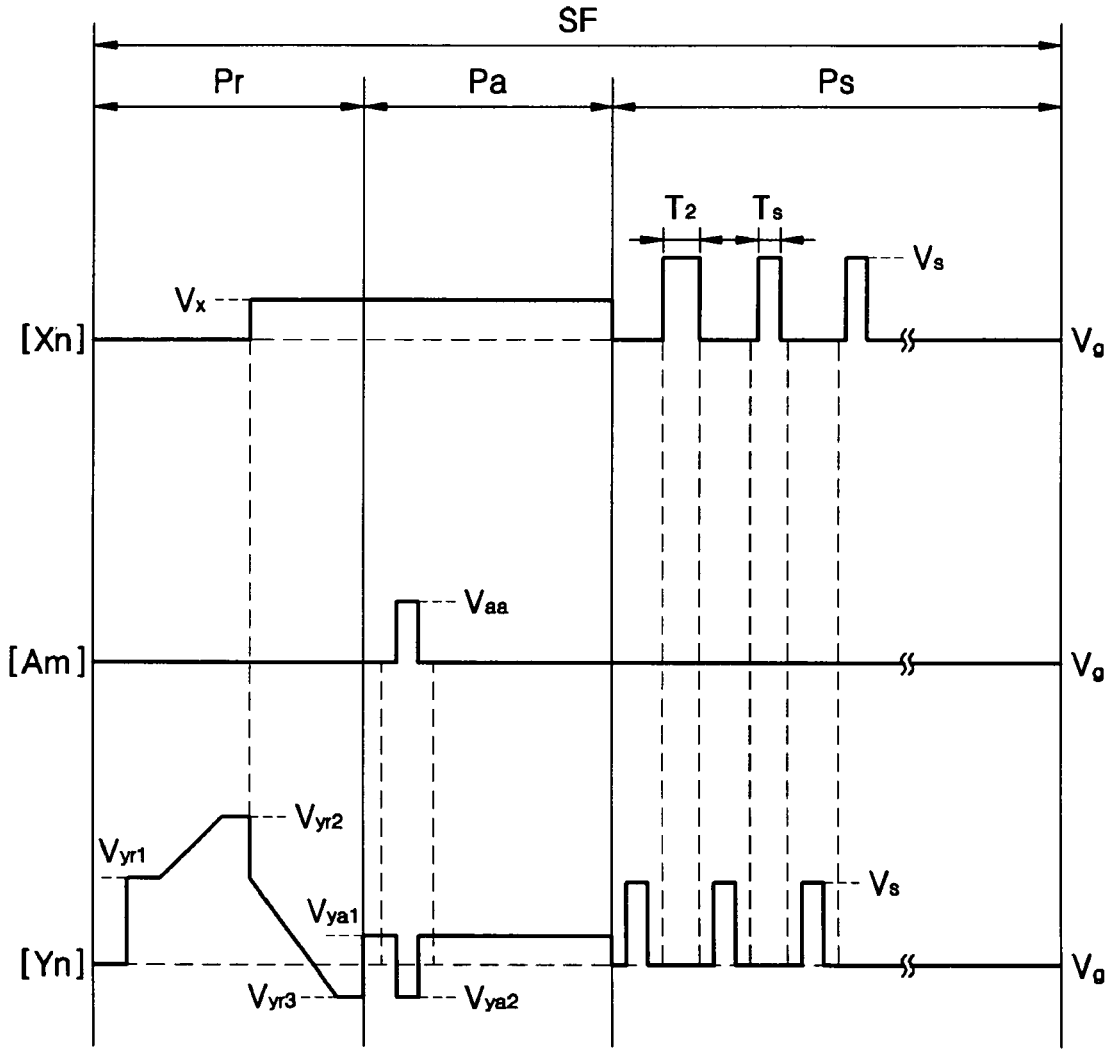
FIG. 7A illustrates a driving waveforms for the PDP having the improved structures of FIGS. 4A through 4D according to a first embodiment of the present invention.
Figure 7B:
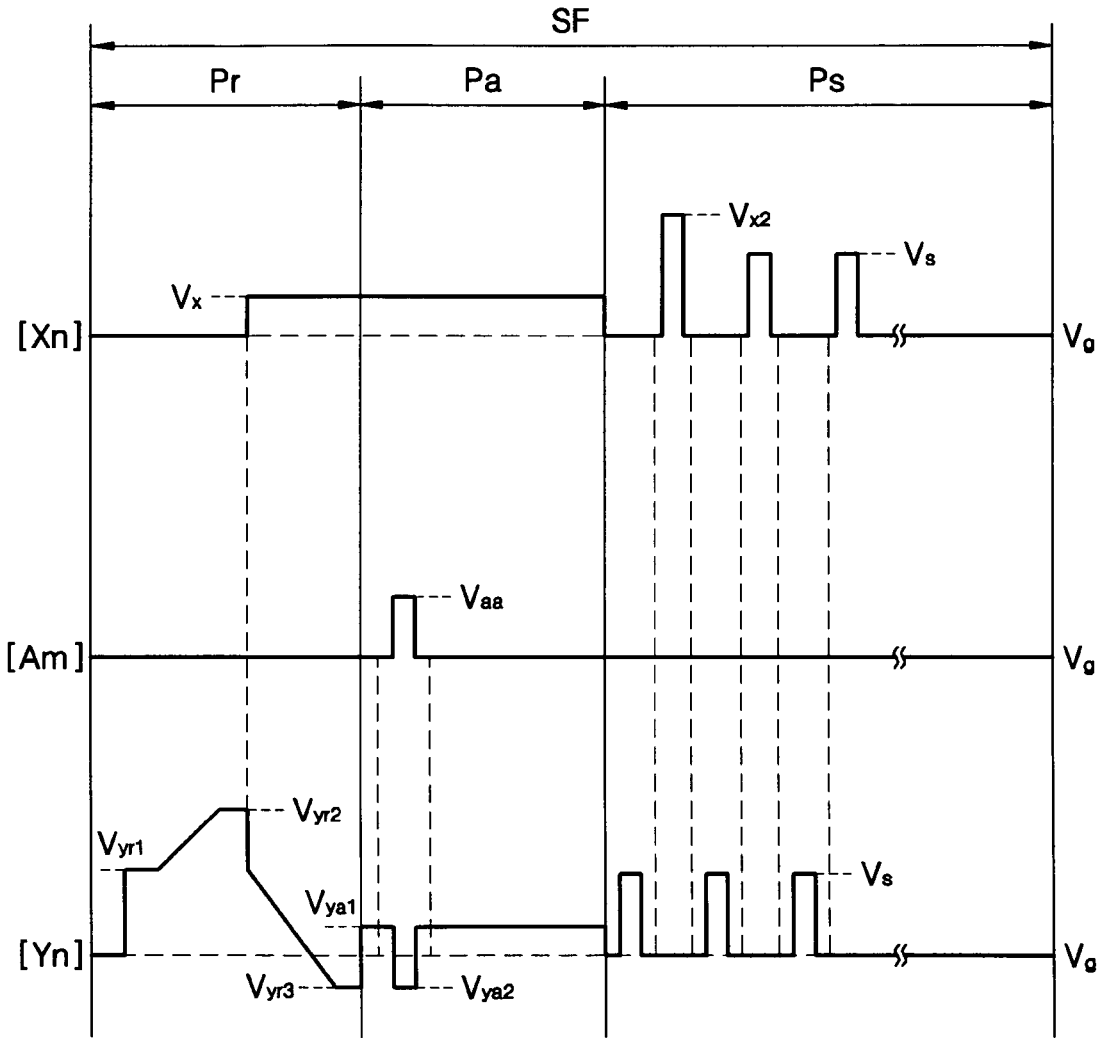
FIG. 7B illustrates a driving waveform for a PDP having an improved structures of FIGS. 4A through 4D according to a second embodiment of the present invention.
Figure 9:
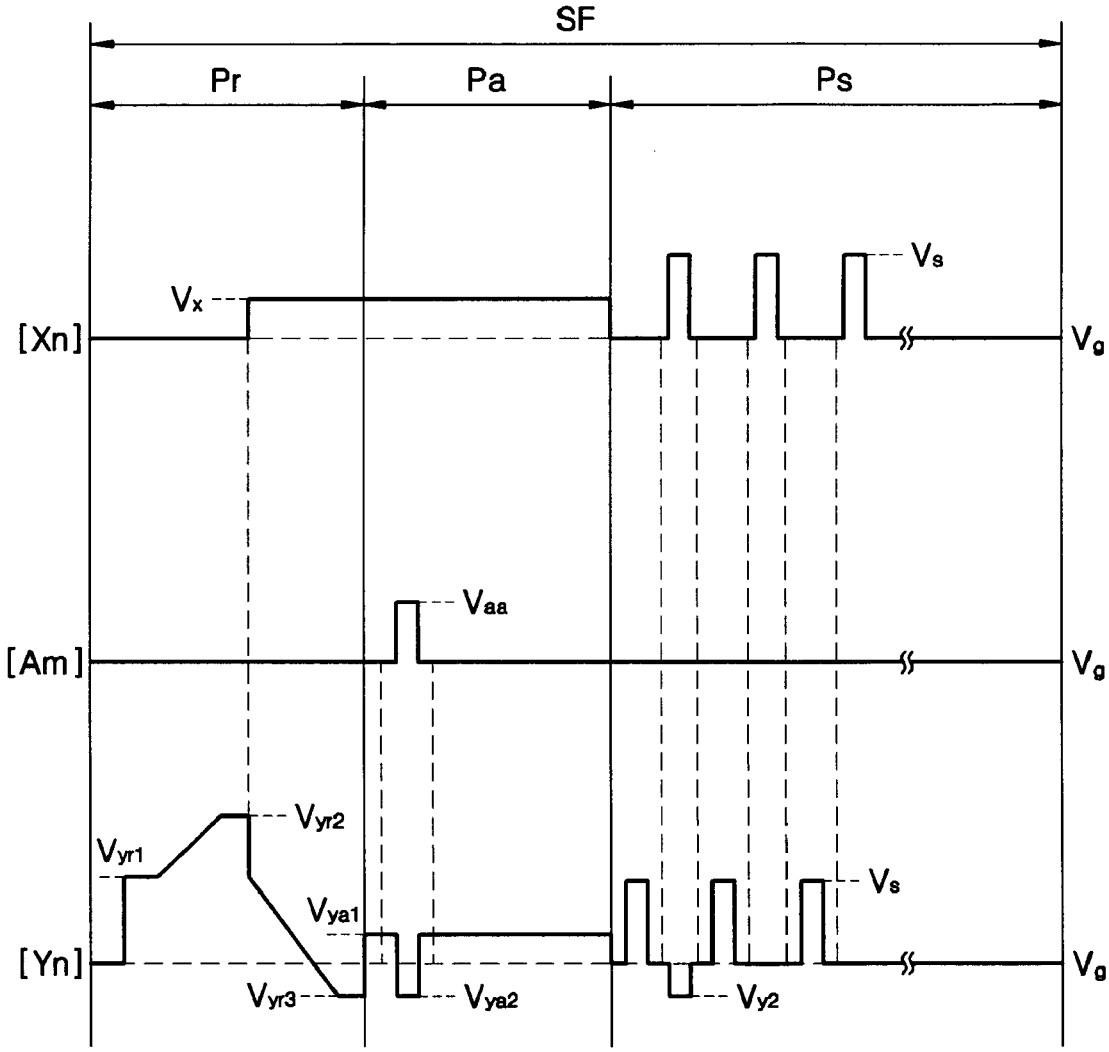
FIG. 9 illustrates a driving waveform for a PDP having an improved structures of FIGS. 4A through 4D according to a third embodiment of the present invention.

In order to solve these problems, the waveforms of 7A, 7B and 9 can be used to successfully drive the structures of FIGS. 4A through 4D according to the first, second and third embodiments of the present invention respectively. To form a stronger electric field than before between the X electrode Xn and the Y electrode Yn in generating the second and subsequent sustain discharges, with regard to a discharge cell having the wall charges as illustrated in FIG. 6B after the first sustain discharge, each embodiment modifies voltages applied to the electrodes during the second sustain discharge of the sustain address period by adding an extra kick not present in the waveforms of the second sustain discharge pulse of FIG. 3. The first embodiment contemplates increasing the pulse width of the first sustain pulse applied to the X electrodes Xn (i.e., the second discharge pulse for the sustain discharge period) as illustrated in FIG. 7A. Alternatively, the second embodiment of the present invention contemplates increasing the electric potential applied to the X electrodes during the first sustain pulse applied to the X electrode as illustrated in FIG. 7B. The third embodiment contemplates modifying an electric potential of a sustain pulse applied to the Y electrodes as illustrated in FIG. 9 during the second sustain pulse of the sustain discharge period. Each of these embodiments will now be sequentially described in more detail.

Referring now to FIGS. 7A and 7B, FIG. 7A illustrates a novel driving waveform of the PDP having the improved structure of FIGS. 4A through 4D according to a first embodiment of the present invention, and FIG. 7B illustrates another novel driving waveform of a PDP having the improved structure of FIGS. 4A through 4D according to a second embodiment of the present invention. FIGS. 7A and 7B are different from FIG. 3 during the second sustain pulse of the sustain discharge period Ps.

Driving waveform voltages applied to each of the electrodes during the reset period Pr that initialize all discharge cells will now be described. A step type waveform voltage that rises from the ground voltage Vg to an X electrode first voltage Vx is applied to the X electrodes Xn, the ground voltage Vg is applied to the A electrodes Am, and a ramp type reset pulse voltage having a rising ramp type waveform voltage and a falling ramp type waveform voltage is applied to the Y electrodes Yn. The rising ramp type waveform voltage rises from a Y electrode reset first voltage $V_{yr1}$ having a higher electric potential than the ground voltage Vg to a Y electrode reset second voltage $V_{yr2}$ having a higher electric potential than the Y electrode reset first voltage $V_{yr1}$ .The falling ramp type waveform voltage falls from the Y electrode reset first voltage $V_{yr1}$ having a higher electric potential than the ground voltage Vg to a Y electrode reset third voltage $V_{yr3}$ having a lower electric potential than Vg.

Driving waveform voltages applied to each of the electrodes during the address period Pa in which a discharge cells are selected for display will now be described. The X electrode first voltage Vx having a higher electric potential than the ground voltage Vg is still applied to the X electrodes Xn, an address pulse voltage having a positive pulse waveform of voltage Vaa is applied to the A electrodes Am, and a scan pulse voltage having a negative pulse waveform of voltage $V_{ya2}$ is applied to the Y electrodes Yn. During this address pulse, the potential of the A electrode rises from Vg to Vaa while the voltage of the Y electrode falls from Vyal to Vya2 (the scan pulse).

Referring now to FIG. 7A, driving waveform voltages applied to each of the electrodes in the sustain discharge period Ps that performs a sustain discharge in a selected discharge cell to be displayed will now be described. In the sustain discharge period Ps, a pulse waveform voltage having alternately a low level voltage Vg and a high level voltage Vs is applied to the X electrodes Xn, and a pulse waveform voltage having alternately the high level voltage Vs and the low level voltage Vg is applied to the Y electrodes Yn. In a period (a period corresponding to period P_2 of FIG. 3, i.e. the second sustain discharge of period Ps or the first pulse applied to the X electrode during period Ps) where the high level voltage Vs is first applied to the X electrode Xn in the sustain discharge period Ps, a high level driving voltage Vs has a longer pulse width T2 than the pulse width Ts of all of the other pulses in period Ps. In other words, this second pulse in period Ps has a larger pulse width T2 than that of FIG. 3 and than that of the other pulses in period Ps. In the sustain discharge period Ps, the pulse width Ts is still applied to pulses subsequent to the second pulse of the period Ps as well as to the first pulse of the period Ps.

Referring now to FIG. 7B and to the second embodiment, a pulse waveform voltage having alternately a low level voltage Vg and a high level voltage Vs is applied to the X electrodes Xn, and a pulse waveform voltage having alternately the high level voltage Vs and the low level voltage Vg is applied to the Y electrodes Yn. In a period (a period corresponding to period P_2 of FIG. 3, i.e. the second sustain discharge of period Ps or the first pulse applied to the X electrodes during period Ps) where the high level voltage is supposed to be first applied to the X electrodes Xn in the sustain discharge period Ps, a different high level driving voltage Vx2 having a higher electric potential than the high level voltage Vs is applied to the X electrodes Xn. In other words, in the second discharge during period Ps, the magnitude of the voltage applied to the X electrodes is increased over that of FIG. 3 and over that of other pulses applied during period Ps in FIG. 7B from Vs to Vx2 to increase the electric field within the discharge cells to a sufficient level so that the second discharge in period Ps can be stable. In the sustain discharge period Ps, an electric potential of high level voltages after a second high level voltage applied to the X electrodes can be equal to an electric potential of high level voltages of FIG. 3. In the sustain discharge period Ps of FIGS. 7A and 7B, the ground voltage Vg having the same electric potential as the low level voltage is applied to the A electrodes Am.

Figure 8A:
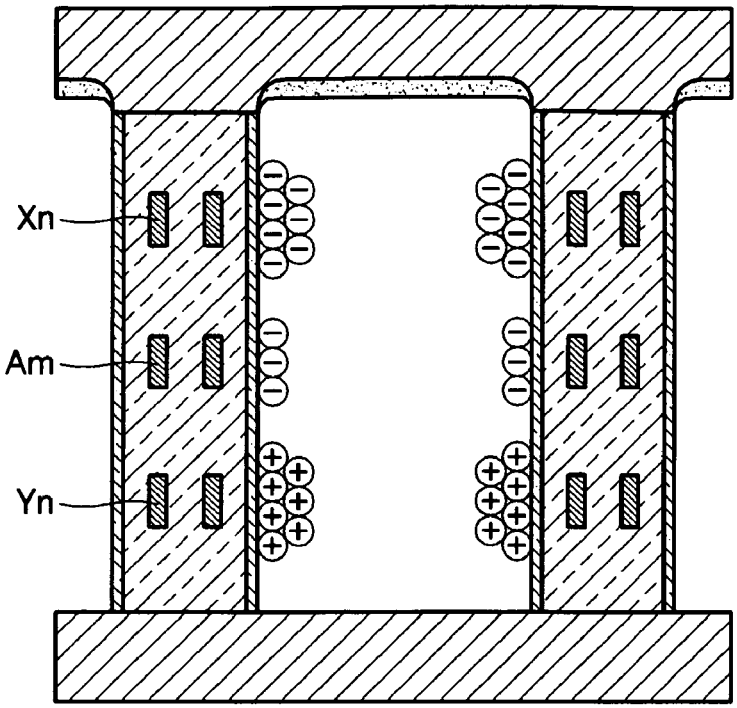
FIGS. 8A through 8D illustrate distributions of wall charges accumulated by applying driving waveform voltages illustrated in FIG. 7A or 7B to the PDP having the improved structure illustrated in FIGS. 4A through 4D.
Figure 8B:
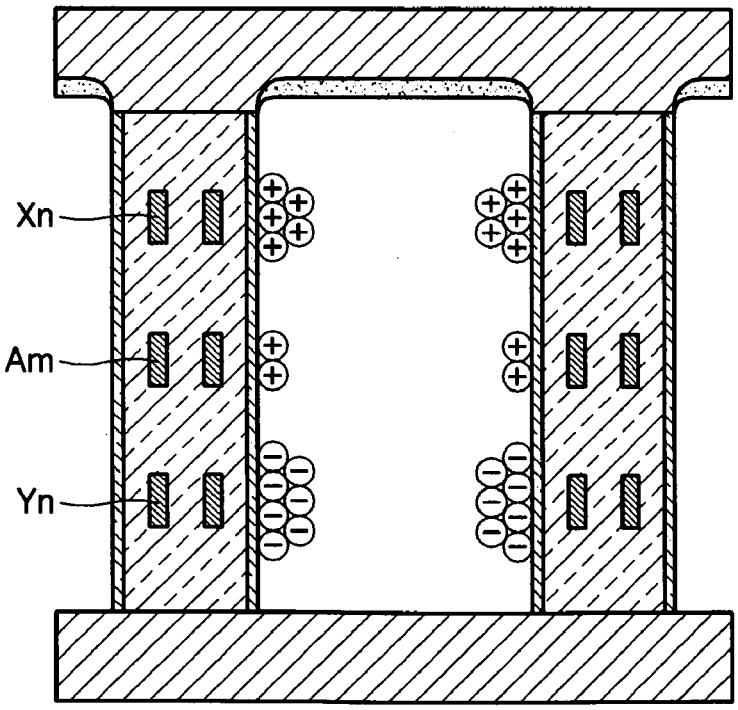

Turning now to FIGS. 8A through 8D, FIGS. 8A through 8D illustrate distributions of wall charges at different points of time during the sub-field SF accumulated when driving waveform voltages illustrated in FIGS. 7A or 7B are applied to the PDP having the improved structure illustrated in FIGS. 4A through 4D. FIG. 8A illustrates a distribution of wall charges around each of the electrodes at the end of the address period Pa, and FIG. 8B illustrates a distribution of wall charges around each of the electrodes at the end of a first sustain discharge in the sustain discharge period Ps.

Since the driving waveform voltage illustrated in FIGS. 7A and 7B are identical to the driving waveform voltage illustrated in FIG. 3 for the reset period Pr and the address period Pa, and for the first discharge in sustain discharge period Ps, the distribution of wall charges illustrated in FIG. 8A is identical to the distribution of wall charges illustrated in FIG. 6A, and the distribution of wall charges as illustrated in FIG. 8B is identical to the distribution of wall charges as illustrated in FIG. 6B.

To remove the unstable second sustain discharge and the subsequent insufficient distribution of wall charges of FIG. 4C, the high level driving voltage having the longer pulse width T2 as illustrated in FIG. 7A is applied to the X electrodes Xn, or the high level driving voltage having a higher electric potential Vx2 as illustrated in FIG. 7B is applied to the X electrode Xn during the second sustain discharge of the sustain discharge period Ps.

When the wall charges as illustrated in FIG. 8B are present after the first sustain discharge of the sustain discharge period Ps, if the high level driving voltage having the longer pulse width T2 as illustrated in FIG. 7A is applied to the X electrode Xn, or the second pulse of period Ps of higher magnitude Vx2 as in FIG. 7B is applied to the X electrode Xn, a stronger electric field is produced than in FIGS. 3 and 6A through 6D between the X electrodes Xn and the Y electrodes Yn for the duration of the second sustain discharge in period Ps. Therefore, even though wall charges accumulated around each of the electrodes after the first sustain discharge are the same, the enhanced voltage waveforms in the second sustain pulse produce an electric field sufficient to guarantee a stable second discharge and then produce even more wall charges for the subsequent third discharge. By doing so, the bad chain reaction of FIGS. 6C and 6D is avoided.

Figure 8C:
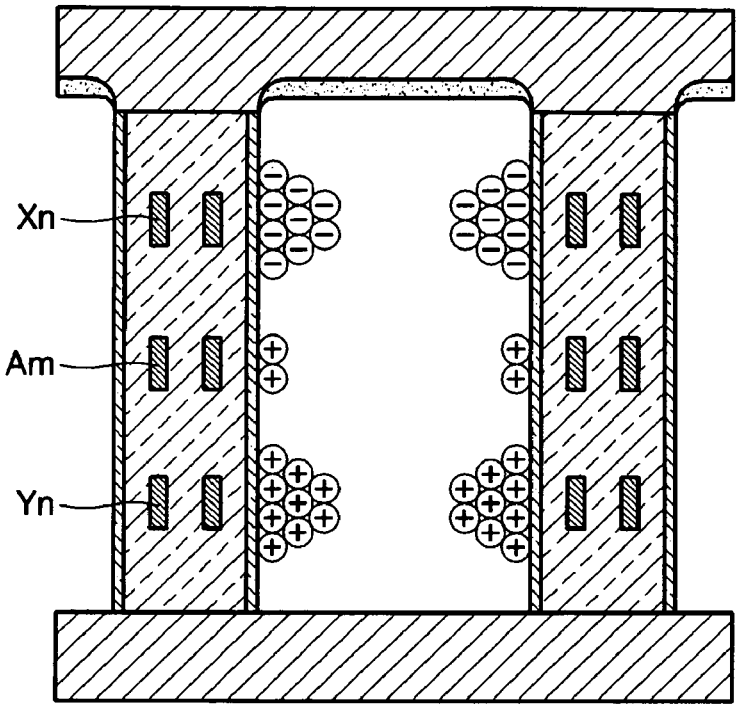

FIG. 8C illustrates a distribution of wall charges around each of the electrodes at the end of the second sustain discharge of the sustain discharge period Ps. If the stable second sustain discharge is generated by applying the high level driving voltage having the long application time T2 as illustrated in FIG. 7A or the high level driving voltage having a high electric potential Vx2 as illustrated in FIG. 7B to the X electrodes Xn when the wall charges as illustrated in FIG. 8B are present, wall charges generated during the second discharge accumulate around the electrodes with a polarity opposite to that of the voltages applied to the electrodes. The resultant is a larger quantity of negative wall charges are formed around the X electrodes Xn in FIG. 8C than in FIG. 6C, a similar quantity of positive wall charges are formed around the A electrodes Am in FIG. 8C as compared to FIG. 6C, and a larger quantity of positive wall charges are formed around the Y electrodes Yn as illustrated in FIG. 8C than in FIG. 6C.

Figure 8D:
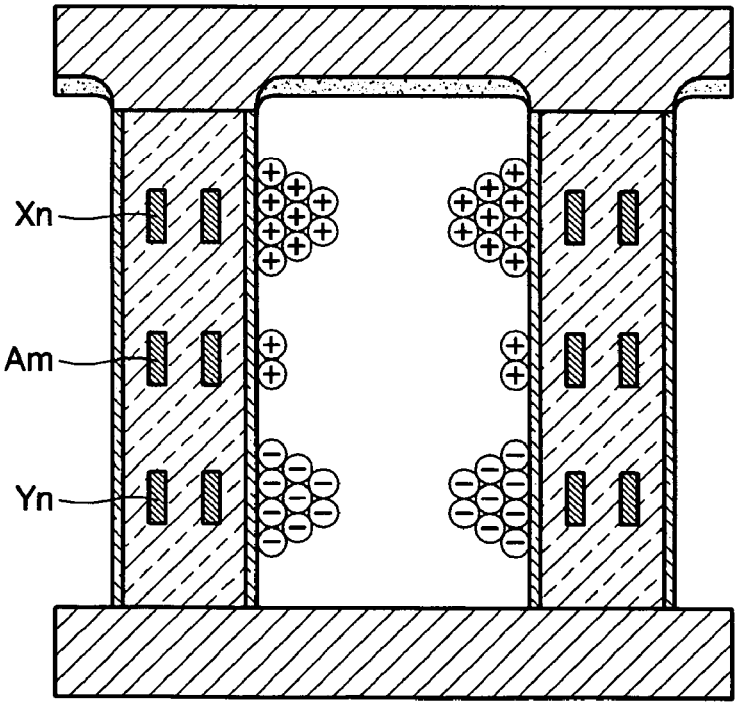

In summary, wall charges are sufficiently accumulated in FIG. 8C as after the second and subsequent discharges as compared with the wall charges accumulated in FIG. 6C, to allow for stable subsequent discharges. Since the second stable sustain discharge results in an accumulation of a sufficient amount of wall charges around each of the electrodes for the third discharge, subsequent sustain discharges can occur stably without modification to the voltage waveforms of the third or subsequent sustain discharge pulses in the sustain discharge period Ps. Since these subsequent stable discharges also leave a legacy of sufficient and enhanced wall charges of FIGS. 8C and 8D, the stage is set for even more stable discharges within period Ps and the chain reaction of FIGS. 6C and 6D is avoided. FIG. 8D illustrates a distribution of wall charges around each of the electrodes at the end of the third sustain discharge of the sustain discharge period Ps. Referring to FIG. 8D, a sufficient amount of wall charges are accumulated as illustrated in FIG. 8C. Such a stable effect sets the stage for a stable fourth sustain discharge.

Turning now to FIG. 9, FIG. 9 illustrates a driving waveform of a PDP having an improved structure according to a third embodiment of the present invention. The driving waveforms illustrated in FIG. 9 and FIG. 7A or 7B are identical to each other in regard to the reset period Pr and the address period Pa. The driving waveforms applied to the Y electrodes Yn as illustrated in FIG. and FIG. 7A or 7B are different from each other in regard to the second sustain discharge of the sustain discharge period Ps. Specifically, during the second discharge of period Ps in FIG. 9, although the voltage pulse applied to the X electrode is identical to that of P_2 in FIG. 3, a small negative voltage Vy2 is simultaneously applied to the Y electrode so that the potential difference between the X and the Y electrodes increases leading to an enhanced electric field within the discharge cells. This small negative voltage Vy2 applied to the Y electrodes during the second sustain discharge when the X electrodes are applied high level voltage Vs is enough to prevent the chain reaction of FIGS. 6C and 6D from starting so that the discharges can continue to be stable and the accumulation of wall charges after the discharges are sufficient for more stable discharges, as in FIGS. 8C and 8D. To be more specific, a first low level driving voltage Vy2 having a lower electric potential than a second low level voltage Vg is applied to the Y electrodes Yn by not increasing (as illustrated in FIG. 7A) the application time or raising (as illustrated in FIG. 7B) the electric potential of the high level voltage applied to the X electrodes Xn in the second sustain discharge, thus generating a stable second sustain discharge. The low level driving voltage Vy2 having a low electric potential is applied to the Y electrodes Yn in the second sustain discharge, resulting in the stable second sustain discharge. The stable effect can influence sustain discharges after a third sustain discharge as illustrated in FIGS. 8C and 8D since sufficient wall charges are also produced during this second sustain discharge.

To form a stronger electric field than in FIGS. 3 and 6A through 6D between the X electrodes Xn and the Y electrodes Yn for generating the second sustain discharge with regard to a discharge cells having the wall charges as illustrated in FIG. 6B after the first sustain discharge, an extra kick is needed to the voltage waveforms applied during the second discharge of period Ps to prevent the bad chain reaction from occurring. This extra kick can come about in three ways as illustrated in FIGS. 7A, 7B and 9 of the present invention. In FIG. 7A, the high level driving voltage having the longer application time T2 is applied to the X electrodes Xn. In FIG. 7B, the higher magnitude driving voltage Vx2 is applied to the X electrodes Xn. In FIG. 9, the electric potential of a sustain pulse voltage applied to the Y electrodes for an electric potential of a low level voltage is reduced. According to the present invention, the PDP having the improved structure makes it possible to generate stable sustain discharges after the second sustain discharge, thus increasing Xs display quality of the PDP.

While the present invention has been particularly shown and described with reference to exemplary embodiments thereof, it will be understood by those of ordinary skill in the art that various changes in form and details can be made therein without departing from the spirit and scope of the present invention as defined by the following claims.

What is claimed is:

1. A method of driving a plasma display panel (PDP), comprising:

providing a plurality of X electrodes and a plurality of Y electrodes extending in a first direction, a plurality of A electrodes arranged between the X electrodes and the Y electrodes and extending in a second direction that crosses the plurality of X electrodes and the plurality of Y electrodes, and a plurality of discharge cells arranged in a region where the A electrodes cross the X electrodes and the Y electrodes; and applying a pulse waveform voltage alternating between a low level voltage and a high level voltage to the X electrodes and applying a pulse waveform voltage alternating between the high level voltage and the low level voltage to the Y electrodes during a sustain discharge period when sustain discharging occurs in selected ones of the plurality of discharge cells, wherein a pulse width of a first high level voltage applied to the X electrodes in the sustain discharge period is larger than pulse widths of all other high level voltage pulses applied during the sustain discharge period.

2. The method of claim 1, wherein during the sustain discharge period, except for the first high level voltage applied to the X electrodes, each of the high level voltages applied to the X electrodes and to the Y electrodes have equal pulse widths.

3. The method of claim 1, further comprising:

applying a first voltage that is higher than a ground voltage to the plurality of X electrodes during an address period;

applying an address pulse voltage of a positive voltage to selected ones of said plurality of A electrodes during said address period; and applying a scan pulse having a negative voltage to the plurality of Y electrodes during said address period, wherein the address period occurs prior to the sustain discharge period, the address period being adapted to select ones of said plurality of discharge cells for discharge during the sustain discharge period.

4. The method of claim 3, further comprising:

applying a rising ramp type waveform voltage and a falling ramp type waveform voltage to the Y electrodes during a reset period;

applying a ground voltage to the selected A electrodes during the reset period; and applying a step type waveform voltage that rises from the ground voltage to the first voltage to the plurality of X electrodes when the falling ramp type voltage is applied to the Y electrodes during the reset period, the reset period occurring before the address period, the reset period being adapted to initialize each of the discharge cells.

5. A method of driving a plasma display panel (PDP), comprising:

providing a plurality of X electrodes and a plurality of Y electrodes extending in a first direction, a plurality of A electrodes arranged between the X electrode and the Y electrode and extending in a second direction that crosses the plurality of X electrodes and the plurality of Y electrodes, and a plurality of discharge cells arranged in a region where the A electrodes cross the X electrodes and the Y electrodes; and applying a pulse waveform voltage alternating between a low level voltage and a high level voltage to the X electrodes and applying a pulse waveform voltage alternating between the high level voltage and the low level voltage to the Y electrodes during a sustain discharge period when sustain discharging occurs in selected ones of the plurality of discharge cells, wherein a high level voltage of a second sustain discharge in the sustain discharge period has a higher electric potential than all other high level voltages applied to the X electrodes and to the Y electrodes during the sustain discharge period.

6. The method of claim 5, wherein the high level voltage applied during the second sustain discharge of the sustain discharge period is applied to one of the X electrodes, wherein, except for the second sustain discharge of the sustain discharge period, a magnitude of each of the high level voltages applied during the sustain discharge period are equal.

7. The method of claim 5, further comprising:

applying a first voltage that is higher than a ground voltage to the plurality of X electrodes during an address period;

applying an address pulse voltage of a positive voltage to selected ones of said plurality of A electrodes during said address period; and applying a scan pulse having a negative voltage to the plurality of Y electrodes during said address period, wherein the address period occurs prior to the sustain discharge period, the address period being adapted to select ones of said plurality of discharge cells for discharge during the sustain discharge period.

8. The method of claim 7, further comprising:

applying a rising ramp type waveform voltage and a falling ramp type waveform voltage to the Y electrodes during a reset period;

applying a ground voltage to the selected A electrodes during the reset period; and applying a step type waveform voltage that rises from the ground voltage to the first voltage to the plurality of X electrodes when the falling ramp type voltage is applied to the Y electrodes during the reset period, the reset period occurring before the address period, the reset period being adapted to initialize each of the discharge cells.

9. A method of driving a plasma display panel (PDP), comprising:

providing a plurality of X electrodes and a plurality of Y electrodes extending in a first direction, a plurality of A electrodes arranged between the X electrode and the Y electrode and extending in a second direction that crosses the plurality of X electrodes and the plurality of Y electrodes, and a plurality of discharge cells arranged in a region where the A electrodes cross the X electrodes and the Y electrodes; and applying a pulse waveform voltage alternating between a low level voltage and a high level voltage to the X electrodes and applying a pulse waveform voltage alternating between the high level voltage and the low level voltage to the Y electrodes during a sustain discharge period when sustain discharging occurs in selected ones of the plurality of discharge cells, wherein a low level voltage applied during the second sustain discharge in the sustain discharge period has a lower electric potential than all other low level voltages applied to the X electrodes and to the Y electrodes during the sustain discharge period.

10. The method of claim 9, further comprising:

applying a first voltage that is higher than a ground voltage to the plurality of X electrodes during an address period;

applying an address pulse voltage of a positive voltage to selected ones of said plurality of A electrodes during said address period; and applying a scan pulse having a negative voltage to the plurality of Y electrodes during said address period, wherein the address period occurs prior to the sustain discharge period, the address period being adapted to select ones of said plurality of discharge cells for discharge during the sustain discharge period.

11. The method of claim 10, further comprising:

applying a rising ramp type waveform voltage and a falling ramp type waveform voltage to the Y electrodes during a reset period;

applying a ground voltage to the selected A electrodes during the reset period; and applying a step type waveform voltage that rises from the ground voltage to the first voltage to the plurality of X electrodes when the falling ramp type voltage is applied to the Y electrodes during the reset period, the reset period occurring before the address period, the reset period being adapted to initialize each of the discharge cells.

12. The method of claim 1, wherein the pulse width of a first high level voltage applied to the Y electrodes in the sustain discharge period being equal to pulse widths of all other high level voltages applied to the Y electrodes during the sustain discharge period.

13. The method of claim 1, further providing a plurality of barrier ribs partitioning a space between the front substrate and the rear substrate into the plurality of discharge cells, the plurality of X electrodes and the plurality of Y electrodes being arranged within the plurality of barrier ribs.

* * * * *